United States Patent [19]

Godwin et al.

[11] 4,113,220

[45] Sep. 12, 1978

[54] ADJUSTABLE GAS CYLINDER CHAIR CONTROL

[75] Inventors: Robert H. Godwin; Herbert E. Collignon, both of Evansville, Ind.

[73] Assignee: Bliss & Laughlin Industries Incorporated, Oak Brook, Ill.

[21] Appl. No.: 764,371

[22] Filed: Jan. 31, 1977

[51] Int. Cl.[2] ..... F16M 11/00; F15B 15/17

[52] U.S. Cl. ..... 248/400; 248/404; 248/188.2; 188/300; 297/347

[58] Field of Search ..... 248/400, 404, 161, 354 H, 248/188.2; 297/345, 347; 188/300, 312, 313; 267/65 R

[56] References Cited

U.S. PATENT DOCUMENTS

| | | | |
|---|---|---|---|
| 2,042,443 | 5/1936 | Buckstone | 248/404 |
| 2,446,127 | 7/1948 | Cramer | 248/400 |
| 2,837,387 | 6/1958 | Greville | 248/404 |
| 3,223,206 | 12/1965 | Bainbridge et al. | 188/300 |
| 3,285,207 | 11/1966 | Hagen | 248/404 |
| 3,388,883 | 6/1968 | Axthammer et al. | 248/188.2 |
| 3,790,119 | 2/1974 | Bauer | 248/161 |
| 3,828,651 | 8/1974 | Dorner et al. | 248/400 |
| 3,921,952 | 11/1975 | Wirge | 248/404 |

FOREIGN PATENT DOCUMENTS

| | | | |
|---|---|---|---|
| 1,554,479 | 1/1970 | Fed. Rep. of Germany | 248/161 |
| 1,164,155 | 9/1969 | United Kingdom | 188/300 |

*Primary Examiner*—Marion Parsons, Jr.
*Attorney, Agent, or Firm*—Woodard, Weikart, Emhardt & Naughton

[57] ABSTRACT

An adjustable gas cylinder control comprising the combination of a single tube defining a single cylinder bore, a single piston slidable in the tube and dividing the tube into a first and a second compartment, a first and a second end plug adapted to sealably fit within the ends of the tube, a single spindle or rod fixedly mounted to the piston and reciprocable in the tube, gas inlet means for charging the sealed first compartment of the tube with gas, and valve means mounted in the piston and spindle for allowing gas flow between the first and second compartments of the tube thereby adjusting the position of the piston in the tube. The tube itself is made of rolled welded sheet metal with its ends having a simple cold formed impression holding the first and second end plugs. Also provided is actuating means including a lever connected to the spindle for actuating the valve means thereby allowing gas flow between the compartments of the tube. The distal portion of the first end plug including the gas inlet means is sized and adapted to fit a variety of chair bases and the distal end of the spindle is tapered and adapted to fit a variety of chair seats. In combination with a chair, the adjustable control provides structural support and allows the height of the chair seat to be readily varied while also providing a cushioning effect to the person seated.

4 Claims, 1 Drawing Figure

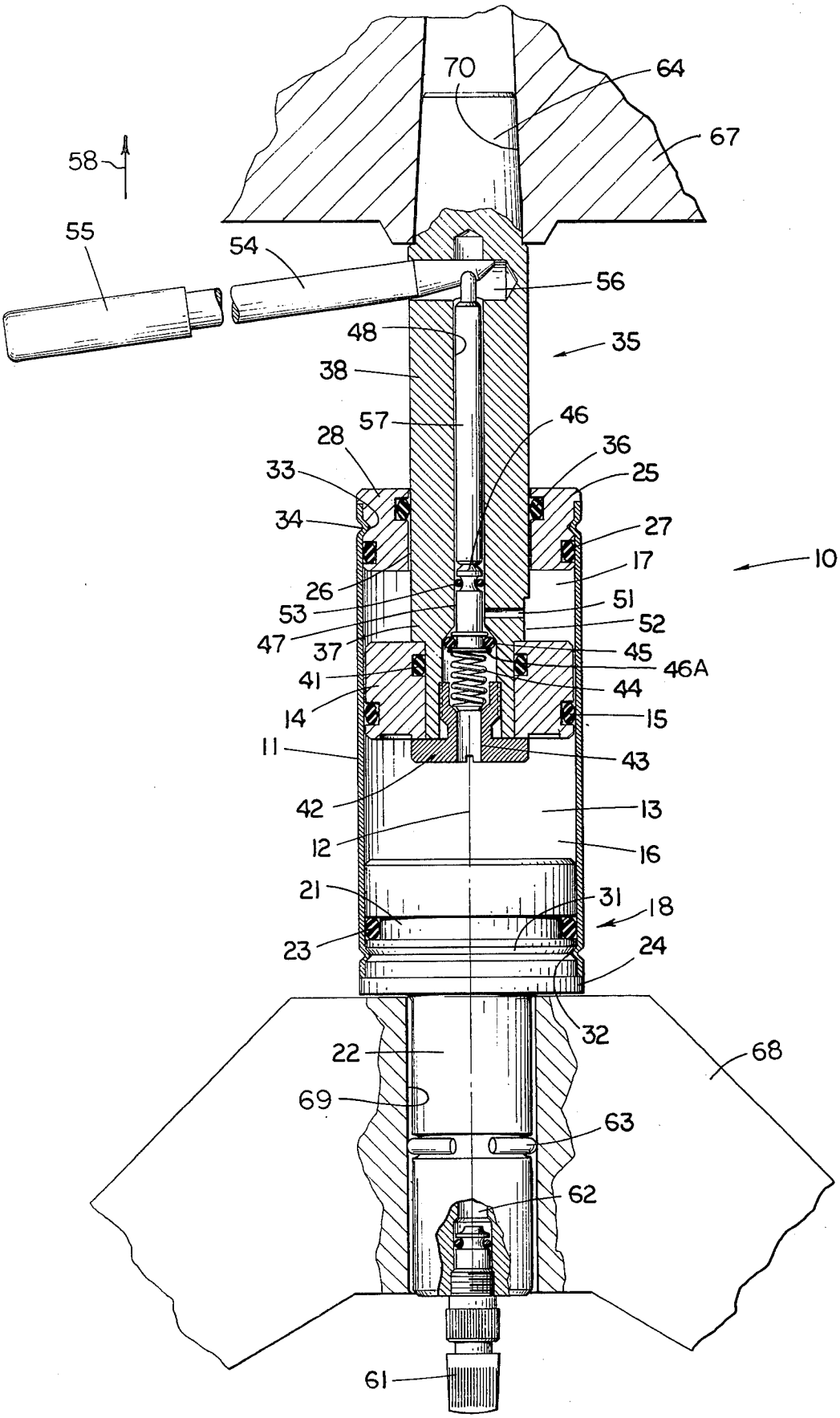
70
64
67
58
55
54
56
48
35
38
57
46
28
36
33
25
34
27
10
17
26
51
53
52
47
37
45
46A
41
44
14
15
11
43
42
13
12
16
21
31
18
23
24
32
22
68
69
63
62
61

ADJUSTABLE GAS CYLINDER CHAIR CONTROL

BACKGROUND OF THE INVENTION

1. Field of the Invention

This invention relates to adjustable gas cylinder controls and particularly to adjustable chair controls.

2. Description of the Piror Art

The use of a gas-operated cylinder and piston combination is well known in the art. Also known is the use of such a combination in connection with a chair base and seat and the use of means for adjusting the overall length of the combination thereby adjusting the height of the chair seat. The following is a list of relevant patents in this regard:

| Pat. No. | Issue Date | Inventor |
|---|---|---|
| 3,656,593 | 4/18/72 | Bauer |
| 3,756,654 | 9/04/73 | Bauer |
| 3,711,054 | 1/16/73 | Bauer |
| 3,790,119 | 2/05/74 | Bauer |
| 3,837,704 | 9/24/74 | Bauer |
| 3,762,514 | 10/02/73 | Freitag |
| 3,787,019 | 1/22/74 | Freitag |
| 3,828,651 | 8/13/74 | Dorner et al. |
| 3,788,587 | 1/29/74 | Stemmler |
| 3,388,883 | 6/18/68 | Axthammer et al. |
| 3,760,911 | 9/25/73 | Porter et al. |
| 3,744,844 | 7/10/73 | Nomaki et al. |
| 3,739,885 | 6/19/73 | Bainbridge |
| 3,712,429 | 1/23/73 | Otto |
| 3,628,637 | 12/21/71 | Axthammer |
| 3,407,909 | 10/29/68 | Seckerson et al. |
| 3,326,604 | 6/20/67 | Billingham et al. |
| 3,528,532 | 9/15/70 | Moskow |
| 3,533,658 | 10/13/70 | Gropp |
| 3,765,720 | 10/16/73 | Sakai |

However varied the cylinder and piston designs in the above references, several general characterizations can be made. First, the majority of designs are intricate and complex arrangements. Several involve more than one cylinder chamber or bore while others divide a single cylinder bore into more than two separate compartments using a variety of walls and partitions. The adjustable controls in such references are also generally intricate arrangements involving the combination of various pins, valves, members, discs, seals and springs. The manufacture of these intricate cylinder and piston arrangements is often detailed and very costly both in terms of time and production expenditures.

Second, as to the prior art cylinder controls specifically adapted for use in a chair, such controls generally require additional structure such as a guide tube in order to adequately support the chair seat and individual, as shown in Stemmler, Bauer U.S. Pat. No. 3,790,119, Bauer U.S. Pat. No. 3,711,054, Bauer U.S. Pat. No. 3,837,704, and Bauer U.S. Pat. No. 3,756,654. Furthermore, the handle or lever provided for adjusting the height of such controls is generally mounted within the housing on the underside of the chair seat thereby complicating removal and preventing the control from being readily interchangeable with various other chair seats and bases.

The present invention alleviates the above disadvantages. A single tube and single piston arrangement is provided wherein construction and manufacture is very simple. The valve means and lever means provided for allowing gas flow between the two compartments in the tube avoid the complexities of the prior art while providing a ready means of adjusting the height of the control. The adjustable chair control comprising the preferred embodiment of the present invention further resolves the problems of prior art controls by providing a structurally sound support which is adapted to fit a variety of chair seats and bases.

SUMMARY OF THE INVENTION

One embodiment of the present invention comprises an adjustable gas cylinder control including a single tube defining a single cylinder bore, a single piston slidable therein and dividing the tube into a first and a second compartment, a first and a second end plug adapted to sealably enclose the compartments of the tube, a single spindle or rod mounted to the piston and axially reciprocable in the tube, gas inlet means for charging the sealed tube with gas, and valve means mounted in the piston and spindle for allowing gas flow between the compartments thereby adjusting the position in the tube. Also provided is actuating means including a lever connected to the spindle for actuating the valve means thereby allowing gas flow between the compartments.

More specifically, the tube is typically made of metal having cold formed impressions holding the first and second end plugs. The distal portions of the first end plug and the spindle are further adapted to fit a variety of chair bases and seats, respectively. The valve means includes a piston screw, a valve seal, connecting means and a compression spring which are operable by a rigid lever and pin to allow the flow of gas between compartments.

An object of the present invention is to provide an adjustable gas cylinder control that is easily manufactured and avoids the complexities of prior art controls.

Another object of the present invention is to provide a gas cylinder control that is readily adjustable as to overall length without requiring a complex multiple cylinder or piston arrangement common to the prior art.

Another object of the present invention is to provide an adjustable gas cylinder chair control that provides structural stability while being readily adjustable and adaptable to fit a variety of chair seats and bases.

BRIEF DESCRIPTION OF THE DRAWINGS

The single FIGURE is a fragmented sectional view of the adjustable gas cylinder chair control comprising and preferred embodiment of the present invention mounted in a standard chair seat and base.

DESCRIPTION OF THE PREFERRED EMBODIMENT

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the single FIGURE, the preferred embodiment of the present invention comprising an adjustable gas cylinder chair control 10 is therein depicted. A single tube 11 constructed of rolled welded sheet steel is provided, having an axis 12 and a single cylinder chamber or bore 13. Extruded tubing might also be used. A single piston 14 including "O-ring" seal 15 is in sealing engagement with the inside surface of the tube and is slidable therein. Piston 14 divides the cylinder bore 13 into a first compartment 16 and a second compartment 17, the size of the respective compartments being determined by the position of the piston in the tube. A 1/16 inch tube wall thickness is typical.

A first end plug 18 having a proximal portion 21 and an elongated distal portion 22 is adapted to sealably fit within one end of the tube thereby sealably enclosing the first compartment 16. An O-ring seal 23 seals the proximal portion 21 of the first end plug to the inside surface of the tube, and an abutment flange 24 is provided to tightly fit against the end wall of the tube. A second end plug 25 having a central bushing surface 26 and an O-ring seal 27 is provided to sealably fit within the other end of the tube thereby sealably enclosing the second compartment 17. A second abutment flange 28 is further provided to tightly fit against the end wall of the tube.

Tube 11 is constructed such that an inwardly-directed ridge or impression is formed into the tube wall near the ends to lock the first and second end plugs in position. In the preferred embodiment, the proximal portion 21 of the first end plug includes a circumferential groove 31 which is tightly held by an inwardly-rolled ridge 32 in the tube wall. The other end of tube 11 includes four prick-punched indentations 34 spaced 90° apart which may enter a groove 33 in the upper end plug 25 like groove 32 in plug 18, thereby locking the second end plug in position.

A single spindle or rod 35 is slidably received in bushing surface 26 in second end plug 25 and sealably engages an inner O-ring seal 36. Plug 25 may be made of anodized aluminum for better performance as a bushing for a steel spindle 35. A nitrile rubber may be used for better performance with the sliding surface of spindle 35. The spindle includes a proximal portion 37 and a distal portion 38. Piston 14 is fixedly mounted on the proximal end of spindle 35 and is sealed thereto by O-ring seal 41, and the spindle and piston are axially reciprocable within the cylinder bore in the tube.

The operation of the adjustble gas cylinder chair control of the preferred embodiment is controlled by a lever and valve arrangement mounted in spindle 35 and piston 14. A piston screw 42 having a central hole 43 is securely mounted in proximal portion 37 of the spindle 35. A compression spring 44 seats against the piston screw and against a flange 46A on the lower end of valve 46. The upper face of this flange bears on the O-ring seal 45 and transmits the spring load to the seal to securely hold it against the conical seal surface in the spindle. The flange 46A can be a disc between the bottom of valve 46 and spring 44, if desired. The valve 46 is slidably received in the center of the spindle and is dimensioned to provide a gap or space 47 between its outer surface and the inner surface 48 of spindle 35. A transverse hole 51 and surface groove 52, which are located in the spindle adjacent the valve 46, serve to complete a valved passageway between first compartment 16 and second compartment 17 of the tube.

Although gas flow between the first and second compartments of the tube is thus possible, the force of compressed spring 44 transmitted to O-ring seal 45 is sufficient to sealably press the seal against the conical valve seat in the spindle, thereby maintaining the seal in a closed position preventing the flow of gas. An O-ring seal 53 is also provided between the valve and inside surface 48, thereby preventing gas from entering or leaving through the distal portion of the spindle.

Gas flow between compartments is accomplished by means of a lever arrangement connected to the distal portion of the spindle. A lever 54 and handle 55 are movably seated in a transverse hole 56 in the spindle. A slidable valve pin 57 is centrally located in the spindle and rigidly extends between lever 54 and valve 46. By moving the lever in direction 58, the lever depresses valve pin 57 thereby moving valve 46 and ring 45 downward and further compressing compression spring 44. With the valve thus in the open position, gas is allowed to flow between the first and second compartments of the tube.

In operation, first compartment 16 of tube 10 is initially charged with gas through an adjustable valve assembly 61 which is connected to the distal end of first end plug 18. A central hole or bore 62 connects the adjustable valve with first compartment 16. The illustrated valve assembly may be conventional as used in wheels for inflation of pneumatic tires.

The adjustable gas cylinder chair control 10 is then mounted to a chair seat and base as shown in the single FIGURE. Distal portion 22 of the first end plug is tubular in cross section and including a friction ring 63 is adapted to fit and be insertable in a variety of standard chair bases having a central housing or bore similar to housing 69 in the FIGURE. In this regard, although the exact dimensions of distal portion 22 can vary greatly, it is beneficial to keep its length about twice its cross-sectional diameter in order to maintain a good structurally sturdy base on which to support the chair seat 67. This stability is further aided by the fact that the underside of abutment flange 24 is adapted to bear against the chair base adjacent the housing 69 when the distal portion 22 is inserted therein. The distal end of spindle 35 located distally from lever 54 and transverse hole 56 has a tapered outer surface 64 and is adapted to fit and be insertable in a variety of standard chair seats having a receiving mount or adapter similar to mount 70 in the FIGURE. As shown in the FIGURE, no additionally structural supports, such as guide tubes, are needed to support the cylinder control between the chair seat 67 and base 68.

For an example of the adjustable gas cylinder chair control of the preferred embodiment in operation, assume a cylinder inside diameter of 1.625 inches, and a pressure of 100 pounds per square inch are introduced through valve 61 into first compartment 16. A force of about 209 pounds is exerted against the piston and spindle. A gross weight of chair and occupant in excess of that force would be needed to cause the piston to move downward, thereby decreasing the volume of first compartment 16 and increasing its internal pressure until an equilibrium is reached. Such an equilibrium is shown in FIG. 1 wherein first compartment 16 is approximately double the volume of second compartment 17. A cushioning effect is experienced by the person being seated during the reaching of this equilibrium, as the piston cycles to its final position.

Lowering the height of the chair seat is accomplished by applying a force in excess of about 50 pounds to the seat and moving lever 54 in the upward direction. Valve 46 is thereby moved to the open position and, because of the increased pressure of the gas in compartment 16, gas will flow into second compartment 17. As the pressure decreases in first compartment 16, piston 14 will move closer to first end plug 18 thereby lowering the height of the chair seat. When the desired position is reached, the individual merely releases lever 54 thereby stopping the flow of gas.

Extending the height of the chair seat is accomplished by removing all force from the seat and again moving the lever 54 in direction 58. Due to the difference in effective piston area between compartment 16 and compartment 17, pressure in compartment 17 will be higher than in 16 so gas will thereupon flow from second compartment 17 into first compartment 16 and the piston 14 will return toward position of abutment with upper end plug 25. When the desired height is reached, the individual need only release lever 54 thereby stopping the flow of gas.

An added advantage accompanying the present invention is that the adjustable valve 61 allows an individual to vary the amount of pressure in the compartments to satisfy the individual's needs. For example, if the individual's weight is such that equilibrium of the pressure in first compartment 16 is reached at a height lower than desired, the individual may increase the chair height by adding more gas through adjustable valve 61 thereby increasing the pressure in first compartment 16. Alternatively, the pressure in tube 11 may also be decreased by means of adjustable valve 61, if so desired. The gas used is typically compressed air. Pressurization is done with the piston 14 abutting end plug 25.

What is claimed is:

1. An adjustable gas cylinder control comprising, in combination:

(a) a single tube having an axis and defining a single cylinder bore;

(b) a single piston in sealing engagement with said tube and slidable therein, said piston dividing said tube into a first and second compartment;

(c) a first end plug having a proximal portion and a distal portion, the proximal portion being adapted to sealably fit within one end of said tube thereby sealably enclosing the first compartment thereof;

(d) a second end plug having a central bushing portion and being adapted to sealably fit within the other end of said tube thereby sealably enclosing the second compartment thereof;

(e) a single spindle in sealing engagement with the bushing in said second end plug and slidable therein, said spindle having a proximal and a distal portion, the proximal portion being axially reciprocable in said tube, said piston being fixedly mounted on the proximal end of said spindle and reciprocable therewith;

(f) gas inlet means connected to said first end plug for charging and discharging the sealed first compartment of said tube with gas;

(g) valve means mounted in said piston and said spindle for allowing gas to flow between the first and second compartment of said tube thereby adjusting the position of said piston in said tube;

(h) lever means connected to the distal portion of said spindle for actuating said valve means;

(i) means for structurally supporting a chair seat and a chair base solely on the distal portion of said spindle and the distal portion of said first end plug, said first and second end plugs additionally comprising an abutment flange adapted to abut the ends of said tube when said first and second end plugs are sealably fitted therein, said gas inlet means comprising an adjustable valve centrally located on the distal end of said first end plug and a central bore through said first end plug connecting said adjustable valve with the first compartment of said tube, said adjustable valve being adapted to allow easy charging and discharging of the sealed first compartment in said tube;

(j) a chair base having a central housing, the distal portion of said first end plug having a length of about twice the cross-sectional diameter thereof and including said adjustable valve being inserted in the housing in said chair base, the abutment flange on said first end plug being adapted to bear against said chair base adjacent the central housing therein; and (k) a chair seat having a receiving mount, the distal end of said spindle located distally from said lever means being tapered and inserted in the mount in said chair seat to structurally support said chair seat thereon and above and apart from said chair base.

2. The control of claim 1 in which said valve means comprises:

(a) a piston screw having a central hole mounted in said piston and the proximal end of said spindle;

(b) a valve seal centrally located in the proximal end of said spindle and slidable therein between two positions corresponding to open and closed gas flow;

(c) connecting means including a transverse hole in said spindle adjacent said valve seal and communicating with a surface groove on the outside of said spindle for connecting the first and second compartments of said tube when said valve seal is in the open position thereby allowing gas flow between the compartments;

(d) and a compression spring compressed between said piston screw and said valve seal, said spring being adapted to maintain said valve seal in the closed position thereby preventing gas flow between the compartments of said tube, said lever means being adapted to move said valve seal between the open and closed positions against the force of said compression spring.

3. The control of claim 2 in which said lever means comprises;

(a) a transverse hole in the distal portion of said spindle and proximal of the tapered distal end of said spindle with said chair seat and mount securely supported thereon;

(b) a rigid lever movably seated in said hole; and (c) a slidable valve pin centrally located in said spindle and rigidly extending between said hole and said valve seal, said lever being operable to depress said valve pin thereby moving said valve seal to the open position thereby allowing gas flow through said piston screw and said connecting means and between the first and second compartments of said tube.

4. The control of claim 1 in which said adjustable valve is a valve assembly for inflating pneumatic tires.

* * * * *